United States Patent [19]

Clair

[11] Patent Number: 4,707,905

[45] Date of Patent: Nov. 24, 1987

[54] METHOD FOR ESTABLISHING A CONNECTION BETWEEN A TUBE END PLATE AND A HEADER BOX

[75] Inventor: Patrice Clair, Courbevoie, France

[73] Assignee: Societe Anonyme des Usines Chausson, Ansieres, France

[21] Appl. No.: 915,886

[22] Filed: Oct. 2, 1986

Related U.S. Application Data

[62] Division of Ser. No. 632,640, Jul. 20, 1984, abandoned.

[30] Foreign Application Priority Data

Aug. 4, 1983 [FR] France ..... 83 12857

[51] Int. Cl.[4] ..... B23P 11/02

[52] U.S. Cl. ..... 29/446; 29/157.3 R; 29/509; 29/513; 29/525; 29/526 R; 29/243.5; 29/283.5; 24/570; 24/703; 165/173

[58] Field of Search ..... 29/525, 450, 509, 513, 29/515, 526 R, 157.3 R, 446, 157.4, 243.5, 283.5; 24/570, 703; 165/173, 175, 149

[56] References Cited

U.S. PATENT DOCUMENTS

| | | | |
|---|---|---|---|
| 2,004,231 | 6/1935 | Wasson | 24/703 X |
| 2,586,931 | 2/1952 | Gammon | 24/570 X |
| 2,650,180 | 8/1953 | Walker | 29/463 UX |
| 3,002,212 | 10/1961 | Tilgner | 29/513 UX |
| 3,055,529 | 9/1962 | Cameron et al. | 29/463 X |
| 3,421,652 | 1/1969 | Warman | 29/463 X |
| 4,461,348 | 7/1984 | Toge et al. | 165/173 |

FOREIGN PATENT DOCUMENTS

| | | | |
|---|---|---|---|
| 872111 | 6/1971 | Canada | 165/173 |
| 28951 | 5/1981 | European Pat. Off. | 165/173 |
| 497144 | 8/1954 | Italy | 165/149 |
| 2070124 | 9/1981 | United Kingdom | 24/570 |
| 2086561 | 5/1982 | United Kingdom | 165/173 |
| 2108648 | 5/1983 | United Kingdom | 165/149 |

*Primary Examiner*—Charlie T. Moon
*Attorney, Agent, or Firm*—Browdy and Neimark

[57] ABSTRACT

The connection device between a tube end plate and a header box of a heat exchanger comprises at least one clamp bearing underneath bottom of a peripheral groove of the tube end plate and on top of a peripheral bearing flange of the header box by means of lugs separated by notches. The clamp is preformed for defining upper lugs and lower lugs, said upper end lower lugs being separated by a measure for which a gasket mounted between the tube end plate and the header box is deformed in a regular manner, and said clamp having at least one lower lug of a greater length than width of the bottom of the peripheral groove of the tube end plate and being bent over beyond said bottom.

5 Claims, 5 Drawing Figures

METHOD FOR ESTABLISHING A CONNECTION BETWEEN A TUBE END PLATE AND A HEADER BOX

This application is a division of application Ser. No. 632,640, filed July 20, 1984, now abandoned.

FIELD OF THE INVENTION

This invention relates to a new connection device between a tube end plate and a header box of a heat exchanger.

The invention applies to heat exchangers in which the tube end plate is covered by a header box maintained in position by clamps including lugs bearing on a peripheral flange of the header box.

BACKGROUND OF THE INVENTION

It is well known in the art to provide clamps which are positioned after the assembly of the header box, the clamps having protruding lugs which are bent over or crimped by means of a press on the bearing flange of the header box, the pressure exerted by the press being such that a gasket interposed between the header box and the tube end plate is pressed for providing a suitable tightness between these two parts.

It has been found that the bending over or crimping of the clamp lugs is not accomplished, in practice, in a uniform manner, so that the lugs exert non uniform pressures on the header box. This disadvantage is further increased by the fact that the bending over or crimping of the clamp lugs often causes a deformation of the back portion of the clamp, which is due to stresses developed from the bent portion of the lugs.

It results from the hereabove mentioned factors that tightness defects can appear between the tube end plate and the header box covering it.

The present invention remedies this disadvantage.

OBJECTS AND SUMMARY OF THE INVENTION

According to a first aspect of the invention, the connection device between a tube end plate and a header box of a heat exchanger comprising at least one clamp bearing underneath bottom of a peripheral groove of the tube end plate and on top of a peripheral bearing flange of the header box by means of lugs separated by notches, is characterized in that the clamp is preformed for defining upper and lower lugs separated by a measure for which a gasket mounted between the tube end plate and the header box is deformed in a regular manner, said clamp having at least one lower lug of a greater length than width of the bottom of the peripheral groove of the tube end plate and being bent over beyond said bottom.

The invention applies also to a method for using the hereabove device.

According to a second aspect of the invention, the method for establishing a connection between a tube end plate and a header box of a heat exchanger in which said connection is provided by a clamp bearing underneath a peripheral groove of the tube end plate and above a peripheral bearing flange of a header box covering the tube end plate and pressing a gasket against said tube end plate, comprises the steps of shaping a clamp having upper and lower bearing portions regularly separated, exerting a compression effort between the tube end plate and the header box in order to deform the gasket, and positioning the clamp by a sliding motion so as to come to bear on one hand on the header box bearing flange and on an other hand against bottom of the tube end plate peripheral groove.

Various other features of the invention will become more apparent from the following detailed description.

BRIEF DESCRIPTION OF THE DRAWINGS

An embodiment of the invention is shown by way of a non limitating example in the accompanying drawings, in which.

DETAILED DESCRIPTION OF THE INVENTION

Figure 5:
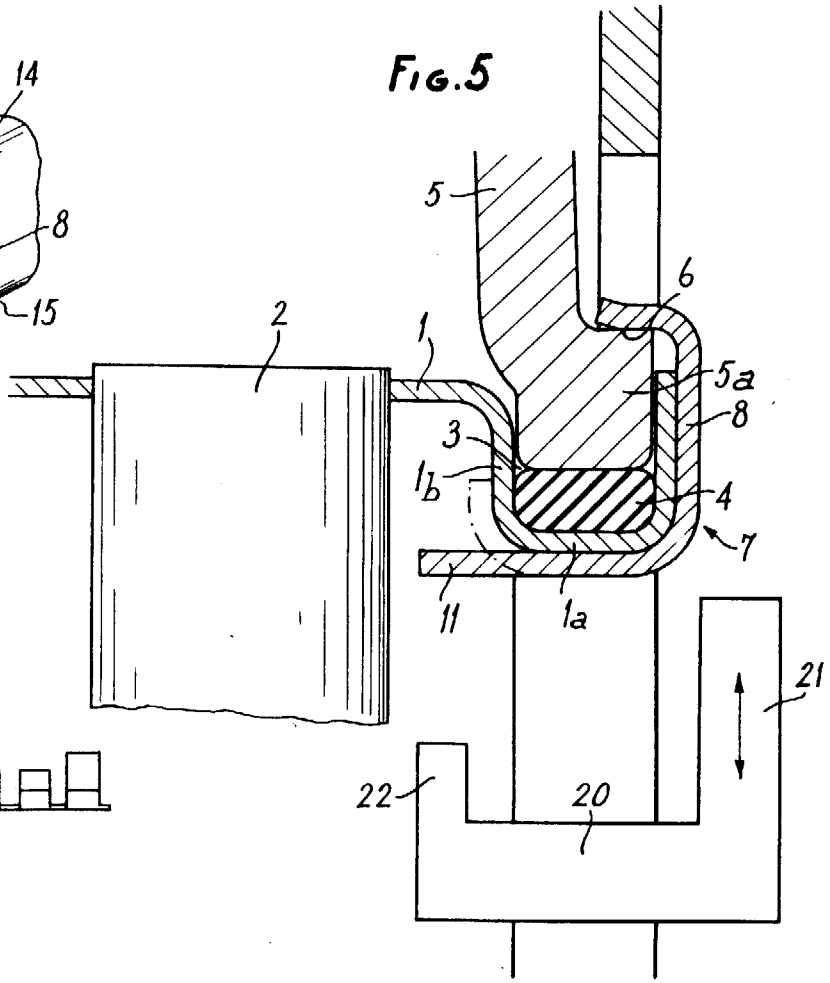
FIG. 5 is an enlarged sectional elevation view of the connection device and of a detail of the tooling used for bringing the connection device in position.
Figure 1:
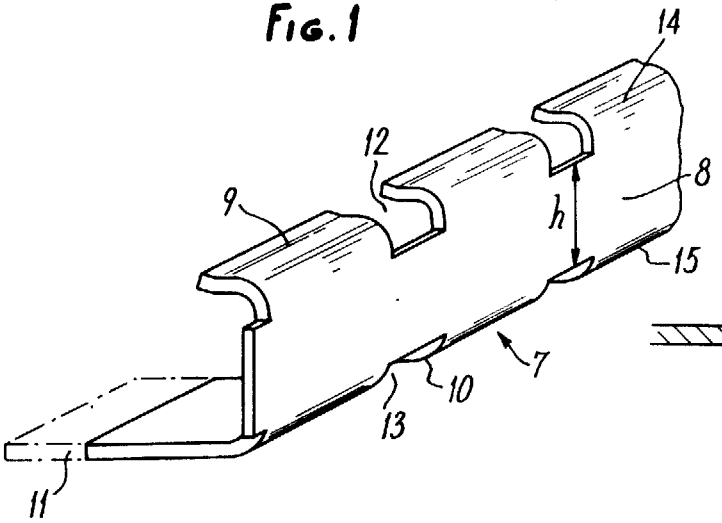
FIG. 1 is a perspective view of a clamped forming the connection device for a tube end plate and a header box.
Figure 2:
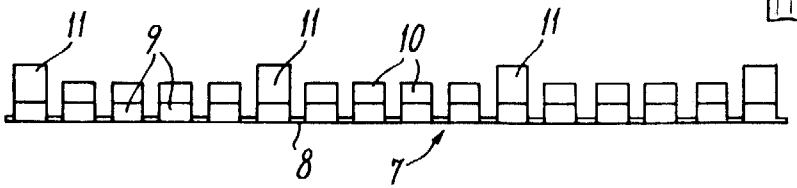
FIG. 2 is a reduced top plan view of the clamp of FIG. 1.
Figure 4:
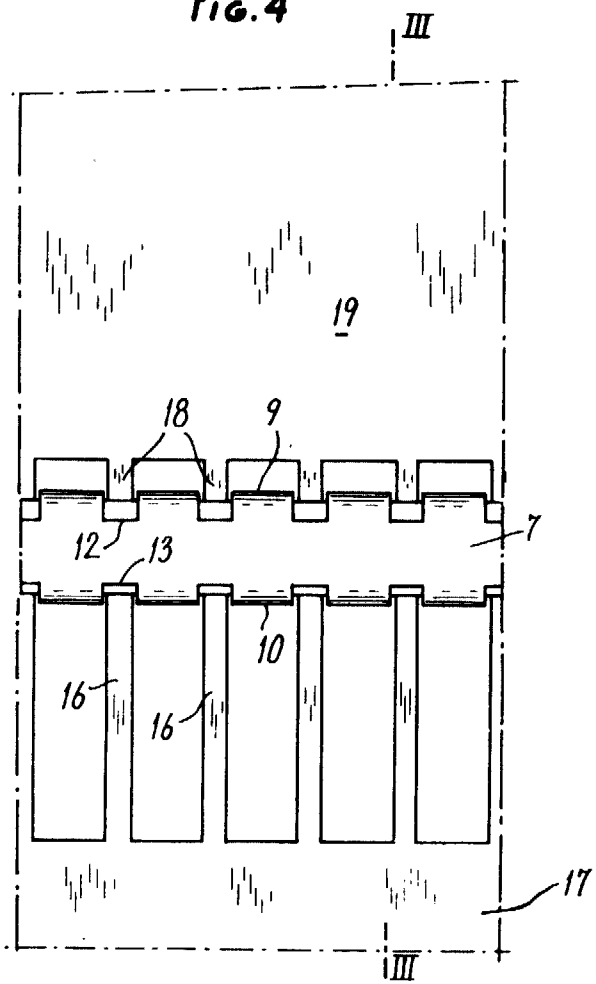
FIG. 4 is a side elevation view taken substantially along line IV—IV of FIG. 3.

In the drawings, reference number 1 designates a tube end plate for circulation tubes 2 of a heat exchanger. Each tube end plate 1 defines in a known manner a peripheral groove 3 in which is placed a deformable gasket 4, for example made of elastomer. The tube end plate 1 is covered by a header box 5 whose edge 5*a* which is engaged in the groove 3 is formed with a peripheral bearing flange 6.

The connection between the header box 5 and the tube end plate 1 is provided by clamps generally shown at 7. Each clamp 7 includes a back portion 8 from which protrude upper lugs 9 and lower lugs 10.

The upper lugs 9 have a length chosen such that it extends over the major portion of the peripheral bearing flange 6 of the header box. The lower lugs 10 are slightly greater in order to extend over the major portion of the bottom 1*a* of the portion of the tube end plate which defines the groove 3, yet without extending up to the upstanding edge 1*b* of the tube end plate. Long lower lugs, shown at 11, are also provided. By way of example, one long lower lug 11 is provided for five plain lower lugs.

Figure 3:
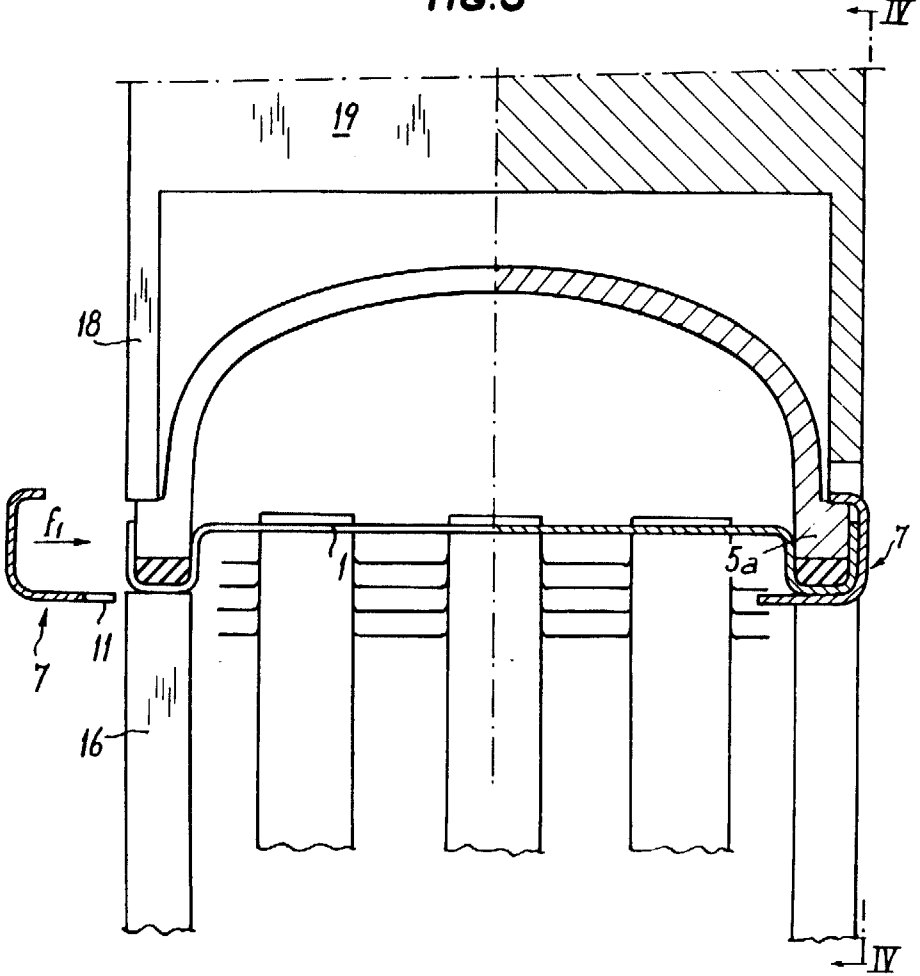
FIG. 3 is an elevation and sectional view taken substantially along line III—III of FIG. 4 of a tooling for bringing the connection device in position on a tube end plate-header box unit.

The drawings, and particularly FIGS. 3 and 5, show that the lower lug 11 are protruding, particularly beyond the bottom 1*a* of the groove of the tube end plate.

The hereabove described clamp 7 is produced by a cutting and bending and/or crimping operation. It is advantageous that height h of the back portion 8 of the clamp 7 makes that the back portion 8 is perfectly plane, meaning that notches 12, respectively 13, which are in register and which separate the upper lug on the one band and the lower lugs on the other hand, will extend up to the end of the rounded portions 13, 14, 15 of the clamp 7.

Since the clamp 7 is cut and preformed before being positioned, its production can be very accurate particularly as regards the measure of the interval separating the faces in register of the upper lugs 9 and lower lugs 10.

For bringing in position the clamps 7 hereabove described, one proceeds as follows: the tube end plate is being supported at the level of the bottom 1*a* which it defines by teeth 16 of a comb 17, width of the teeth 16 being less or at most equal to width of the notches 13.

Once the gasket 4 and the header box 5 are in position, a compression effort is applied on the peripheral bearing flange 6 of the header box by teeth 18 of a second comb 19, the teeth 18 having a width less or at most equal to width of the notches 12.

The pressure applied by the combs 17 and 19 compresses the gasket 4 slighty more than this is necessary for bringing the clamp 7 in position by a sliding motion and a smooth friction, as shown by an arrow $f_1$ in FIG. 3. The compression pressure can thereafter be slightly reduced in order that the bottom 1*a* of the tube end plate 1 on the one hand and the peripheral bearing flange 6 of the header box 5 on the other hand comme in tight contact with the corresponding walls of the clamp 7.

Prior to removing the combs 17 and 19, a crimping comb 20 (FIG. 5) is moved, the crimpring comb 20 having a continuous edge 21 for bearing on the whole length of the back portion 8 of each clamp 7. The comb 20 is formed on the other hand with lugs 22 corresponding to the long lower lugs 11.

The effect of the upward displacement of the comb 20, as shown in FIG. 5, is first to bring the continuous edge 21 against the back portion 8 of the clamp 7, and therefore to maintain the back portion 8 over its whole length before the lugs 22 will begin to act on the protruding portion of the long lower lugs 11.

The comb 20 still moving upwardly, the lugs 22 cause a bending over of the protruding portion of the long lower lugs 11, this being shown in chain-dot lines in FIG. 5. This bending over provides a locking of the clamp 7 with respect to the tube end plate-header box unit, without this this bending operation having any effect as regards the measure of the distance separating the upper lugs 9 from the lower lugs 10 or 11, so that the deformation pressure of the gasket 4 is perfectly uniform all along the clamp 7.

The invention is not limited to the embodiment shown and described in detail and various modification can be envisaged without departing from its scope, as shown in the dependent claims.

What is claimed is:

1. A method for establishing a connection between a tube end plate and a header box of a heat exchanger in which said connection is provided by a clamp bearing underneath a peripheral groove of the tube end plate and above a peripheral bearing flange of a header box covering said tube end plate and pressing a gasket against said tube end plate, comprising the steps of shaping a clamp having upper and lower spaced bearing portions regularly separated lengthwise exerting a compression effort at spaced locations between the tube end plate and the header box in order to deform said gasket, and while said compression is maintained positioning the clamp by a sliding motion between said spaced locations so as to come to bear on one hand on substantially the entire surface of the bearing flange between said spaced compression locations of the header box and on another hand against substantially the entire surface of the bottom of the peripheral groove between said spaced compression locations of the tube end plate.

2. A method according to claim 1, comprising the further step of providing notches in the upper and lower portions of the clamp and applying a compression effort between the tube end plate and the header box by means of teeth of combs bearing against the tube end plate and the header box while extending through said notches.

3. A method according to claim 1, comprising the further step of locking the clamp onto the tube end plate after having been brought in position by sliding motion.

4. A method according to claim 3, wherein the step of providing a locking of the clamp with the tube end plate, includes providing said clamp with at least one long lower lug having a length greater than width of the peripheral groove of the tube end plate, and bending the end of said lug over against and inner edge of said tube end plate.

5. A method according to claim 4, wherein end of said at least one long lower lug is bent over while back portion of the clamp which is brought in position by a sliding motion is maintined by a continuous edge of a crimping comb.

* * * * *

UNITED STATES PATENT AND TRADEMARK OFFICE

CERTIFICATE OF CORRECTION

PATENT NO. : 4,707,905

DATED : November 24, 1987

INVENTOR(S) : CLAIR, Patrice

It is certified that error appears in the above-identified patent and that said Letters Patent is hereby corrected as shown below:

Column 2, line 12, "clamped" should be --clamp--.

Column 2, line 59, "band" should be --hand--.

Column 4, line 12, a comma (--,--) should be added after "lengthwise".

Column 4, line 42, "maintined" should be --maintained--.

Signed and Sealed this

Seventh Day of June, 1988

*Attest:*

*Attesting Officer*

DONALD J. QUIGG

*Commissioner of Patents and Trademarks*